United States Patent [19]

Folson et al.

[11] Patent Number: 4,750,701

[45] Date of Patent: Jun. 14, 1988

[54] CHAIR HEIGHT ADJUSTMENT MECHANISM

[75] Inventors: Henry J. Folson, Redondo Beach; William M. Carpenter, Encino, both of Calif.

[73] Assignee: Illinois Tool Works, Inc., Chicago, Ill.

[21] Appl. No.: 46,407

[22] Filed: May 5, 1987

[51] Int. Cl.[4] ..... F16M 11/00

[52] U.S. Cl. ..... 248/406.1

[58] Field of Search ..... 248/669, 405, 406.1, 248/406.2; 297/348, 347; 108/147

[56] References Cited

U.S. PATENT DOCUMENTS

| | | | |
|---|---|---|---|
| 1,160,108 | 11/1915 | Hasty | 248/406.1 |
| 1,334,660 | 3/1920 | Loeffler | 248/406.1 |
| 2,058,451 | 10/1936 | Herold | 248/406.1 |
| 2,412,451 | 12/1946 | Foote | 248/406.1 |
| 2,674,301 | 4/1954 | Harting | 248/406.1 |
| 3,161,396 | 12/1964 | Anderson | 248/405 |
| 3,386,697 | 6/1968 | Helms | 248/406.1 |
| 3,707,930 | 1/1973 | Yindra | 248/406.1 |
| 3,711,054 | 1/1973 | Bauer | 248/161 |
| 3,741,514 | 6/1973 | Snurr | 248/412 |
| 3,778,014 | 12/1973 | Driscoll | 248/406.1 |
| 3,799,485 | 3/1974 | Wolters | 248/406.1 |
| 4,113,220 | 9/1978 | Godwin | 248/188.2 |
| 4,261,540 | 4/1981 | Baker | 248/406.2 |
| 4,493,469 | 1/1985 | Holobaugh | 248/406.1 |

FOREIGN PATENT DOCUMENTS

| | | | |
|---|---|---|---|
| 661938 | 4/1963 | Canada | 248/406.1 |

*Primary Examiner*—J. Franklin Foss
*Assistant Examiner*—Robert A. Olson
*Attorney, Agent, or Firm*—J. P. O'Brien; T. W. Buckman

[57] ABSTRACT

A control assembly for adjustable displacement of a chair seat or the like comprises a lead screw threaded to a nut for relative longitudinal movement in order to adjust the height of the chair with the relative movement of the screw and nut. The control assembly also includes a rotational bearing for swiveling the seat while maintaining the desired seat height; the rotational bearing also allows backdriving, for example rotation of the screw, without rotation of the seat. The control assembly also includes a locking mechanism for selectively preventing relative movement of the screw with respect to the nut in order to maintain the desired seat height. A power spring can be provided on the assembly to drive selective elevation, for example of the screw and seat, when the screw has been unlocked.

17 Claims, 2 Drawing Sheets

CHAIR HEIGHT ADJUSTMENT MECHANISM

BACKGROUND OF THE INVENTION

This invention relates to height or displacement adjustment mechanisms for chairs and similar fixtures, and more particularly relates to mechanisms for adjusting the height of chairs which are designed to swivel without altering the previously adjusted height of the chair seat.

In order to selectively adjust the height of a chair seat, tabletop or similar fixture, relative to the base of the fixture, numerous height adjustment mechanisms have been developed as described, for example, in U.S. Pat. Nos. 3,161,396; 3,711,054; 3,741,514 and 3,778,014. Since modern office chairs are designed to allow swiveling of the seat without modifying the height of the seat which the user wishes to maintain, the arrangement of the height adjustment mechanism must also enable such swiveling. Further height adjustment mechanisms incorporating a threaded screw and nut arrangement for swiveling chairs are described for example in U.S. Pat. Nos. 3,386,697; 3,799,485; 4,113,220; 4,261,540; and 4,493,469.

SUMMARY OF THE INVENTION

A control assembly for adjustable displacement of a chair seat or the like comprises a lead screw threaded to a nut for longitudinal movement with respect to the nut in order to adjust the height of the chair with the longitudinal movement of the screw. The control assembly also includes a rotational bearing carried on the screw for swiveling the seat while maintaining the desired seat height; the rotational bearing also allows backdriving rotation of the screw without rotation of the seat.

The control assembly also includes a locking mechanism for selectively preventing relative movement of the screw with respect to the nut in order to maintain the desired seat height. The locking mechanism can include a rotationally stationary locking member which is separated from the nut and held rotationally stationary by supporting structure for the assembly. In a preferred embodiment, a manually operable push rod extends slidably through the screw and a locking collar is mounted on the rod so that a small displacement of the rod and collar can selectively lock the collar against a mating cam member mounted on the end of the screw, to hold the screw stationary with respect to the nut; after locking the screw the previously adjusted seat height is maintained while allowing for seat swivel on the rotational bearing. A power spring can be provided on the assembly to drive selective elevation of the screw and seat when the screw has been unlocked from the locking collar.

DETAILED DESCRIPTION OF THE ILLUSTRATED EMBODIMENT

Figure 1:
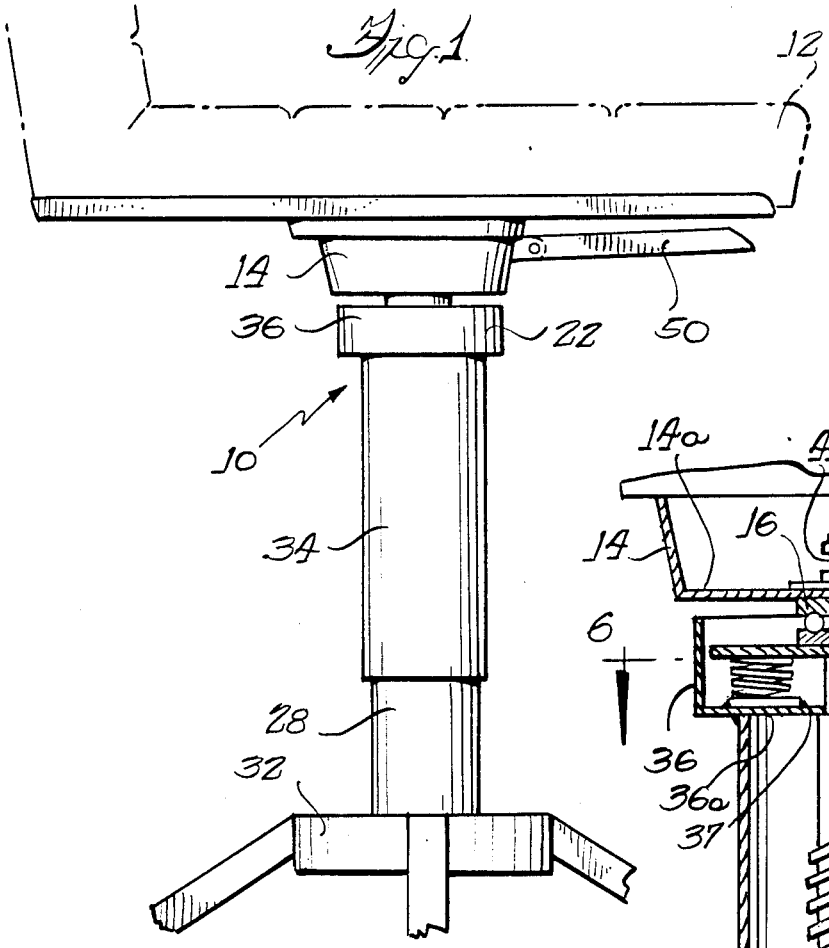
FIG. 1 is an elevation view of an embodiment of the displacement control assembly of the invention, illustrating installation of the assembly in a chair for adjusting the height of a seat shown in phantom.

The following description of the embodiment of the height adjustment assembly in the drawings is an example of the invention, but does not indicate limitation upon the scope of the appended claims.

Figure 2:
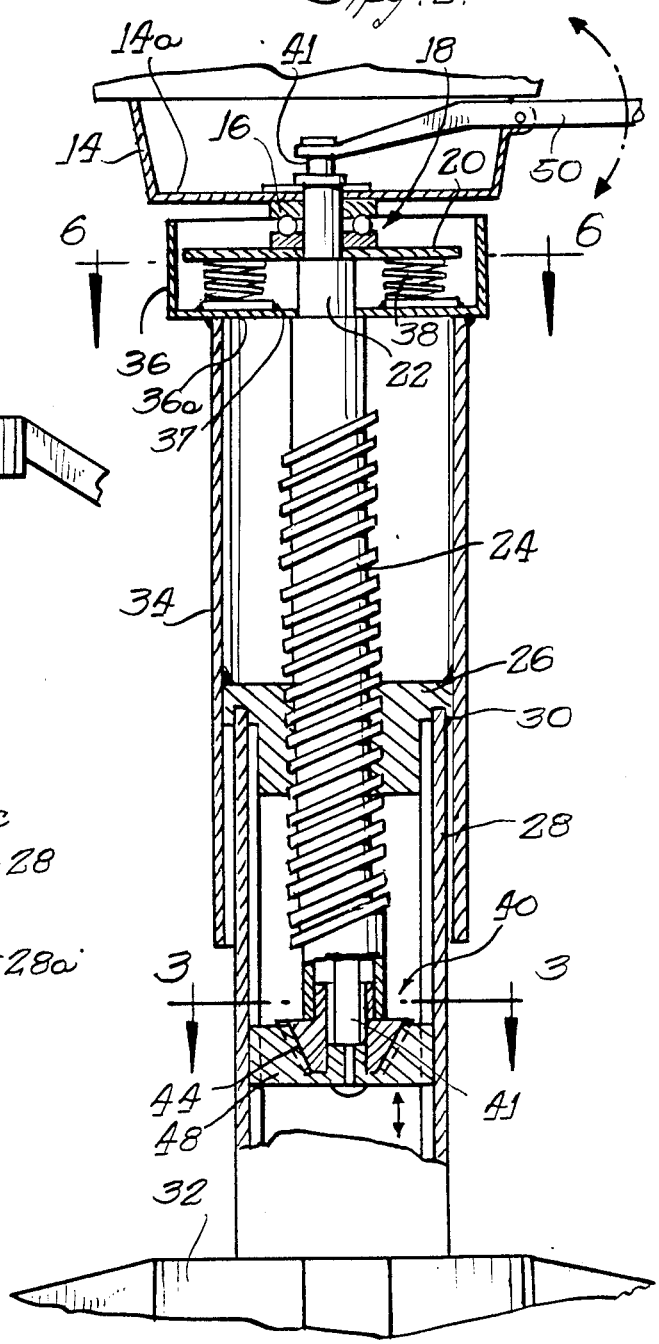
FIG. 2 is a sectional view taken along the chair axis of the embodiment depicted in FIG. 1 and viewed in the indicated direction, and illustrating a vertically displaceable screw threaded to a nut and a rotational bearing carried on the screw for swiveling the chair seat.
Figure 3:
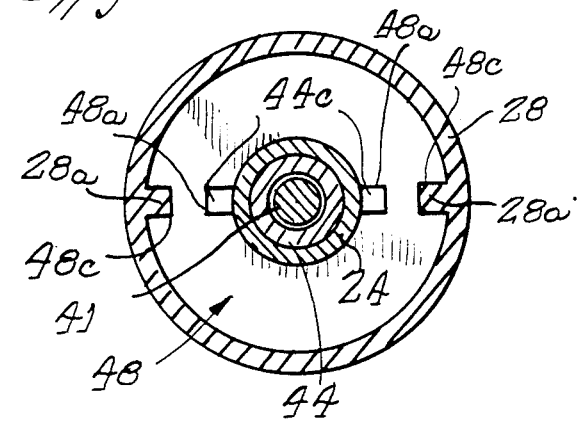
FIG. 3 is a sectional view taken along the line 3—3 in FIG. 2 and viewed in the indicated direction, and illustrating the locked position of a selectively activated locking mechanism which prevents movement of the screw.

Referring to FIG. 1, a height adjustment assembly generally designated by reference character 10, supports a chair having a seat 12 which both swivels and adjusts to variable height. As shown in FIG. 2, seat 12 is supported on a bowl 14 whose bottom wall **14*a* is secured to a washer 16 which is rotatable on a ball thrust bearing 18. The bearing 18 allows the seat 12 to swivel without altering the desired height. The bearing 18 is secured on a large annular flange 20 which is seated on an annular shoulder formed on an unthreaded shaft 22 extending upwardly from an externally threaded, high-pitch lead screw 24. The shaft 22 projects through coaxially aligned, central apertures formed through the flange 20, bearing 18, washer 16 and bottom wall 14*a***.

The screw 24 turns through an internally threaded, stationary nut 26 which also supports the screw 24. The nut 26 is supported on a cylindrical column 28 whose upper end is secured within an annular groove 30 formed in the nut 26. The bottom end of the column 28 is secured within the chair base 32. A cylindrical post 34 is secured to the peripheral annular wall of the nut 26 and extends vertically upwardly from the nut 26. The upper end of the post 34 supports a bottom, end wall **36*a* from which a cylindrical collar 36 extends vertically upwardly. The bottom wall 36*a* has a central aperture 37 through which the screw 24 and shaft 22 can travel in vertically reciprocal motion to adjust the height of the bowl 14 and seat 12. One or more helical springs 38 are mounted so that the lower ends thereof are secured to the wall 36*a* and the upper ends of the springs are secured on the lower surface of the flange 20 which moves vertically with the shaft 22 resulting in expansion or compression of the springs 38. The central aperture through the flange 20 forms a journal which allows the shaft 22** to rotate within the flange.

Figure 4:
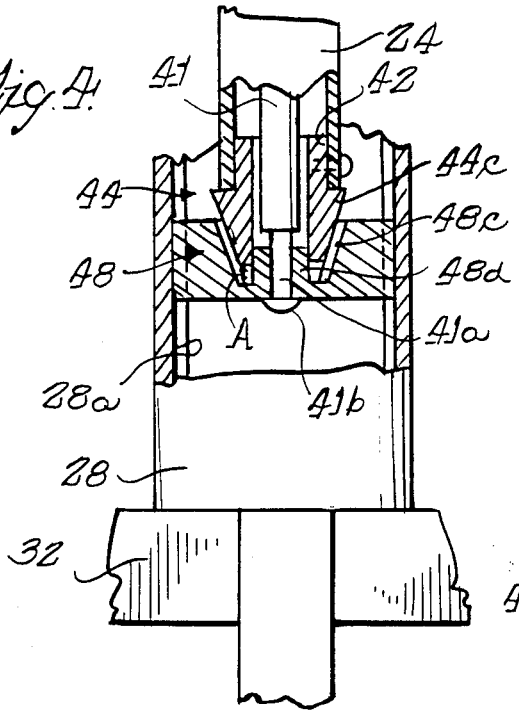
FIG. 4 is a sectional view broken away from FIG. 2 but illustrating the unlocked position of the locking mechanism.
Figure 5:
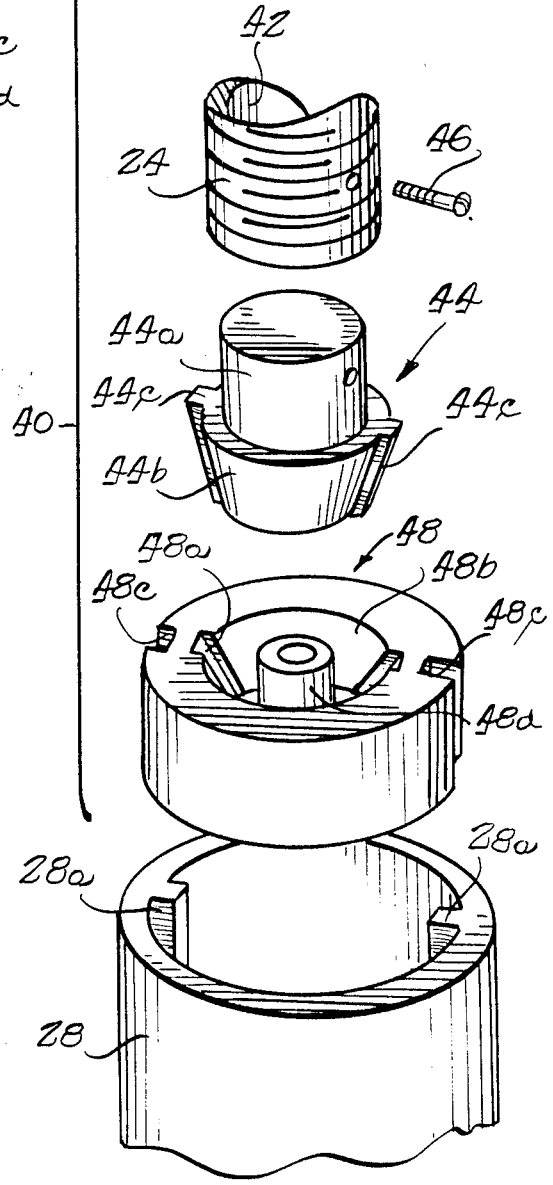
FIG. 5 is an enlarged, exploded view of the locking mechanism shown in FIGS. 2–4.
Figure 6:
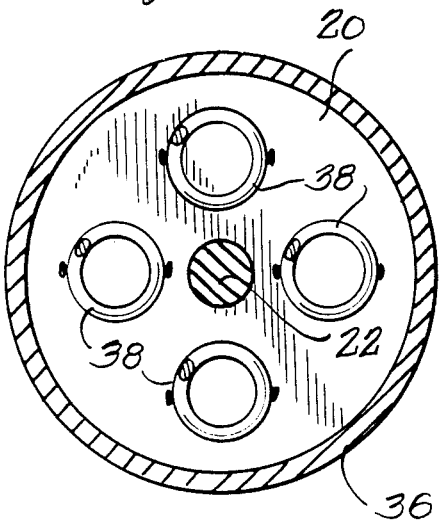
FIG. 6 is a sectional view taken along line 6—6 in FIG. 2, viewed in the indicated direction and illustrating the arrangement of helical springs shown in FIG. 2 for driving elevation of the unlocked screw.

A lock-release push rod 41 is slidable within a central bore formed entirely through the shaft 22, screw 24 and a lock assembly generally designated by reference character 40. As shown in FIGS. 2–5, the lock assembly 40 is mounted on the bottom end of the screw 24. As best illustrated in FIGS. 4 and 5, the lower end of the screw 24 has a counterbore 42 which receives the cylindrical portion **44*a* of a locking key member generally designated by reference character 44. The cylindrical portion 44*a* is secured within the bore 42 by a set screw 46 which projects through apertures formed through the screw 24 and cylindrical portion 44*a*, as best shown in FIG. 4. A truncate, conical portion 44*b* forms the lower, downwardly tapered portion of the key 44 which projects from the bottom of the screw 24. The conical portion 44*b* includes one or more radially outwardly projecting tongues 44*c* which are inclined along the taper of the conical key portion 44*b* and are removably received within respective, mating grooves 48*a* formed in a lock collar 48. The grooves 48*a* radially extend outwardly from the central, conical well 48*b* into which the conical, key portion 44*b* is removably inserted and locked. The lock collar 48*a* has a pair of radially inwardly extending grooves 48*c* which receive mating respective tongues 28*a* projecting radially inwardly from the interior surface of the column 28. The tongues 28*a* extend axially along the column 28 enabling the collar 48 to vertically slide within the column 28 along the tongues 28*a* and also preventing any rotation of the collar 48**.

The push rod 41 has an extension **41*a* projecting through the key 44 and through a tubular boss 48*d* formed centrally within the well 48*b* and integral with the collar 48. An enlarged head 41*b* formed at the end of the rod extension 41*a* is secured to the lower surface of the collar 48**.

Comparison of FIGS. 2 and 4 illustrates the short stroke length A of the push rod 41 with respect to the screw 24. When the push rod 41 is raised to the position shown in FIG. 2 by lowering the manual lever 50 connected to the top of the rod 41, the lock collar 48 is also elevated the short stroke length A until the key tongues **44*c* are locked within the collar grooves 48*a* so that the screw 24** is locked against rotation and the desired height of the seat is maintained.

Referring to FIG. 4, when the seat height adjustment operation is performed to either elevate or lower the seat 12, the key tongues **44*c* are withdrawn from the collar grooves 44*a* by manually raising the lever 50 to downwardly displace the rod 41 which lowers and withdraws the lock collar 48 from the key 44. The resulting unlocking allows backdriving of the screw 24 through the nut 26 to lower the seat 12 without rotation of the seat itself under the applied load of the seat occupant. The screw 24 and seat 12 can be elevated by manually pulling upwardly on the seat or by expansion of the compressed springs 38 against the flange 20, when the occupant load is removed from the seat. After performing the seat height adjustment, the screw 24 and key 44** are locked to maintain the desired seat height.

Since the lock collar 48 is mounted on the bottom of the push rod 41 it travels with the elevated or lowered translation of the screw 24 and is guided by sliding of the grooves **48*c* along the mating column tongues 28*a*. Because the lock collar 48 travels with the screw 24, only a small displacement of the push rod 41 and lock collar is necessary to again lock the key tongues 44*c* within the collar grooves 48*a*. The conical configuration of the key portion 44*b* and the incline of the key tongues 44*c* provide extended, locking engagement of the key tongues 44*c* within the mating inclined collar grooves 48*a* with a conveniently small displacement of the collar 48** to either completely clear the tongues from the grooves or entirely lock their engagement.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A control assembly for adjustable displacement of a chair seat or the like, comprising: a lead screw threaded to a nut for relative axial movement of the screw with respect to the nut, to adjust displacement of said seat with said movement; rotational bearing means for swiveling said seat with respect to said screw and nut; and lock means for selectively preventing relative movement of said screw and nut, said lock means includes a locking structure separated from said nut.

2. The assembly according to claim 1 wherein said locking member is held rotationally stationary by a column supporting said assembly.

3. The assembly according to claim 2 wherein said locking member is movable in translation with said longitudinal movement of the screw.

4. The assembly according to claim 3 wherein said translational movement of said locking member is guided by engagement of respective mating formations on said locking member and column.

5. The assembly according to claim 1 further comprising key means fixed on said screw for selective engagement with said locking member to prevent movement of the screw.

6. The assembly according to claim 5 wherein said key means comprises a conically-shaped cam member selectively received within said locking member.

7. The assembly according to claim 6 wherein said cam member includes at least one tongue projecting therefrom for selective locking insertion within a mating groove formed within said locking member.

8. The assembly according to claim 1 wherein said lock means further comprises manually operable linkage means for activating said selective screw locking.

9. The assembly according to claim 8 wherein said linkage means comprises a push rod on which said locking member is engaged and selectively displaced to provide said locking upon manual operation of said rod.

10. The assembly according to claim 5 wherein said key means is mounted at one end of said screw.

11. The assembly according to claim 9 wherein said push rod extends axially through said screw and is selectively displaceable with respect thereto, and wherein said locking member is axially spaced from said end of said screw for selective locking engagement with a key means upon said selective displacement of said rod.

12. The assembly according to claim 1 further comprising spring means for enabling selective automatic elevation of said screw upon selective inactivation of said lock means.

13. The assembly according to claim 12 wherein said spring means comprises at least one helical spring seated upon a stationary support member and bearing upon a flange member mounted on said screw for expansion of said spring thereagainst in order to drive said screw elevation.

14. A control assembly for adjustable displacement of a chair seat or the like, comprising: a lead screw threaded to a nut for relative axial movement of the screw with respect to the nut, to adjust displacement of said seat with said movement; rotational bearing means for swiveling said seat with respect to said screw and nut; and lock means for selectively preventing relative movement of said screw and nut, said lock means includes a locking structure separated from said screw and having a rotationally stationary locking member.

15. The assembly according to claim 14 wherein said locking member is held rotationally stationary by a column supporting said assembly.

16. The assembly according to claim 15 wherein said locking member is movable in translation with longitudinal movement of the nut.

17. The assembly according to claim 16 wherein said translational movement of said locking member is guided by engagement of respective mating formations on said locking member and column.

* * * * *